US005954226A

United States Patent [19]

Peterson

[11] Patent Number: 5,954,226

[45] Date of Patent: Sep. 21, 1999

[54] ENVELOPE DISPENSING APPARATUS FOR AN ATM

[76] Inventor: Curtis J. Peterson, Box 5, Glenlea, Manitoba, Canada, R0G 0S0

[21] Appl. No.: 09/018,886

[22] Filed: Feb. 5, 1997

[51] Int. Cl.[6] ..... B65H 1/08

[52] U.S. Cl. ..... 221/59; 271/2

[58] Field of Search ..... 221/56, 58, 59, 221/60, 232, 279; 271/2, 160, 169, 178; 206/215, 449, 817

[56] References Cited

U.S. PATENT DOCUMENTS

| | | | |
|---|---|---|---|
| 2,638,211 | 5/1953 | Spurr | 221/60 X |
| 3,861,563 | 1/1975 | Lisbin et al. | 221/279 |
| 3,919,972 | 11/1975 | Komori et al. | 271/169 X |
| 4,679,703 | 7/1987 | De Luca | 221/59 X |
| 5,640,664 | 6/1997 | Ukei et al. | 271/2 X |

*Primary Examiner*—William E. Terrell
*Assistant Examiner*—Gene O. Crawford
*Attorney, Agent, or Firm*—Adrian D. Battison; Murray E. Thrift

[57] ABSTRACT

Apparatus for dispensing flat rectangular envelopes includes a rectangular cartridge container shaped to receive the envelopes in a stack with an open mouth and a movable rear wall pushed by a spring to present the stack at the open mouth. A first cover plate is mounted on the container for holding the stack within the container leaving one part of the mouth open to expose the front envelope of the stack. A second cover plate is separate from the container with a substantially planar plate portion for mounting in a support wall and presenting forwardly of the support wall and side flanges extending rearwardly from the plate portion to define a receptacle for the container into which the container can be attached for holding the container behind the plate portion and from which the container can be detached for removal and re-filling. The second cover plate has an opening therein aligned with said one part of the open end of the container at which one end of the front envelope is exposed for withdrawal of the front envelope through the opening. The container has a flange at one end which hangs on a wall of the front cover plate and a spring fastening blade at the other end.

18 Claims, 4 Drawing Sheets

ENVELOPE DISPENSING APPARATUS FOR AN ATM

BACKGROUND OF THE INVENTION

This invention relates to an apparatus for dispensing envelopes or similar objects for example for use an ATM for storing and supplying deposit envelopes for use at the ATM.

It is well known that customers using an ATM often have to deposit documents into the ATM machine and in order that these are properly identified for later sorting, the document must be enclosed within an envelope which is fed into the ATM machine by the customer. The ATM machine therefore generally include a supply of such envelopes for use by the customers as required.

In some cases the supply of envelopes is merely provided as a stack of the envelopes at a suitable location on a horizontal counter top available at the ATM.

In other cases the horizontal counter top includes a recess into which the envelopes are located in vertically stacked arrangement so that the upper ends of the envelopes are available for grasping by the customer. These arrangements are generally untidy and lead to a wastage of envelopes since they can become strewn around the area and spoiled either accidentally by the customers or by activities of children and the like.

SUMMARY OF THE INVENTION

According to one aspect of the invention there is provided an apparatus for dispensing flat envelopes which are rectangular in plan comprising:

a rectangular container having two first side walls which are parallel and spaced by a width of the envelopes and two second side walls at right angles to the first side walls and spaced by a length of the envelopes to receive and contain the envelopes arranged in a stack, an open front end and a rear end;

a movable end wall in front of the rear end and generally transverse to the side walls for engaging a rear end of the stack;

a spring between the rear end and the end wall biasing the end wall along the container for pushing the stack toward the open front end of the container to present a front one of the envelopes in turn from a front end of the stack;

and a cover plate over the open end of the container, the cover plate having an opening therein at which one end of the front envelope is exposed for withdrawal of the front envelope through the opening, the opening extending in a direction along the length of the envelope from a first edge at one of the second side walls to a second edge partly along the container and the opening extending in a direction across the width of the envelope from one of the first side walls to the other of the first side walls.

Preferably the spring is arranged so as to provide a greater force on the movable end wall at an end thereof at the opening than at an end thereof opposite to the opening.

Preferably there is provided an abutment plate inclined relative to the open end of the container and the cover plate in a direction away from the opening and into the container for contacting the front envelope and holding the front envelope inclined to the cover plate with said one end presented into the opening.

Preferably the cover plate includes a raised lip along the second side of the opening, the lip being inclined from a position spaced from the second side forwardly and toward the second side so as to present the second side forwardly of the cover plate to allow the edge of the front envelope to be presented in the opening forwardly of the cover plate.

According to a second aspect of the invention there is provided an apparatus for dispensing flat envelopes which are rectangular in plan comprising:

a rectangular container having two first side walls which are parallel and spaced by a width of the envelopes and two second side walls at right angles to the first side walls and spaced by a length of the envelopes to receive and contain the envelopes arranged in a stack, an open front end and a rear end;

a movable end wall in front of the rear end and generally transverse to the side walls for engaging a rear end of the stack;

a spring between the rear end and the end wall biasing the end wall along the container for pushing the stack toward the open front end of the container to present a front one of the envelopes in turn from a front end of the stack;

a first cover plate mounted on the container for holding the stack within the container, the first cover plate being shaped to leave one part of the open front end at one of the first side walls open to expose the front envelope of the stack at said one part;

and a second cover plate separate from the container, the second cover plate having a substantially planar plate portion for mounting in a support wall and presenting forwardly of the support wall, flanges extending rearwardly from the plate portion to define a receptacle for the container into which the container can be mounted for holding the container behind the plate portion and from which the container can be detached for removal and re-filling with envelopes;

the second cover plate having an opening therein aligned with said one part of the open end of the container at which one end of the front envelope is exposed for withdrawal of the front envelope through the opening, the opening extending in a direction along the length of the envelope from a first edge at one of the second side walls to a second edge partly along the container and the opening extending in a direction across the width of the envelope from one of the first side walls to the other of the first side walls.

Preferably the first cover plate is pivotally attached to the container allowing the first cover plate to be opened for insertion of further envelopes into the stack by pushing down on the movable end wall.

Preferably the first cover plate is pivotal relative to the container at an end thereof opposite the opening.

Preferably the first cover plate includes a pair of side members each extending along a respective one of the second sides of the container and each including fastening means for engaging the first cover plate to the container.

Preferably the flanges of the second cover plate are arranged for engagement into side edges of an opening in the support wall.

Preferably the flanges are spaced inwardly from an outer edge of the plate portion to define a surrounding lip of the plate portion.

Preferably the container attaches to the second cover plate by a hanger member at one of the first side walls by which an element of the container engages over an abutment of the second cover plate and a snap fastening engagement at the opposed one of the first side walls.

Preferably the second cover plate includes a depending wall at said opposed one of the first side walls and the container includes a spring blade attached to and inclined outwardly from said opposed one of the first side walls for engaging a catch portion of the spring blade into an opening in the depending wall.

Preferably the second cover plate includes a depending wall at said one of the first side walls and the container includes a flange attached to and extending outwardly from an end of said one of the first side walls at said open mouth for engaging of the flange into an opening in the depending wall.

Preferably the second side walls of the container each include a slot and the movable end wall includes a pair of projections each engaging into a respective one of the slots for sliding movement along the slot.

Preferably the first cover plate has an edge at said part which is spaced from the second edge of the opening in the second cover plate in a direction away from the first edge of the opening.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
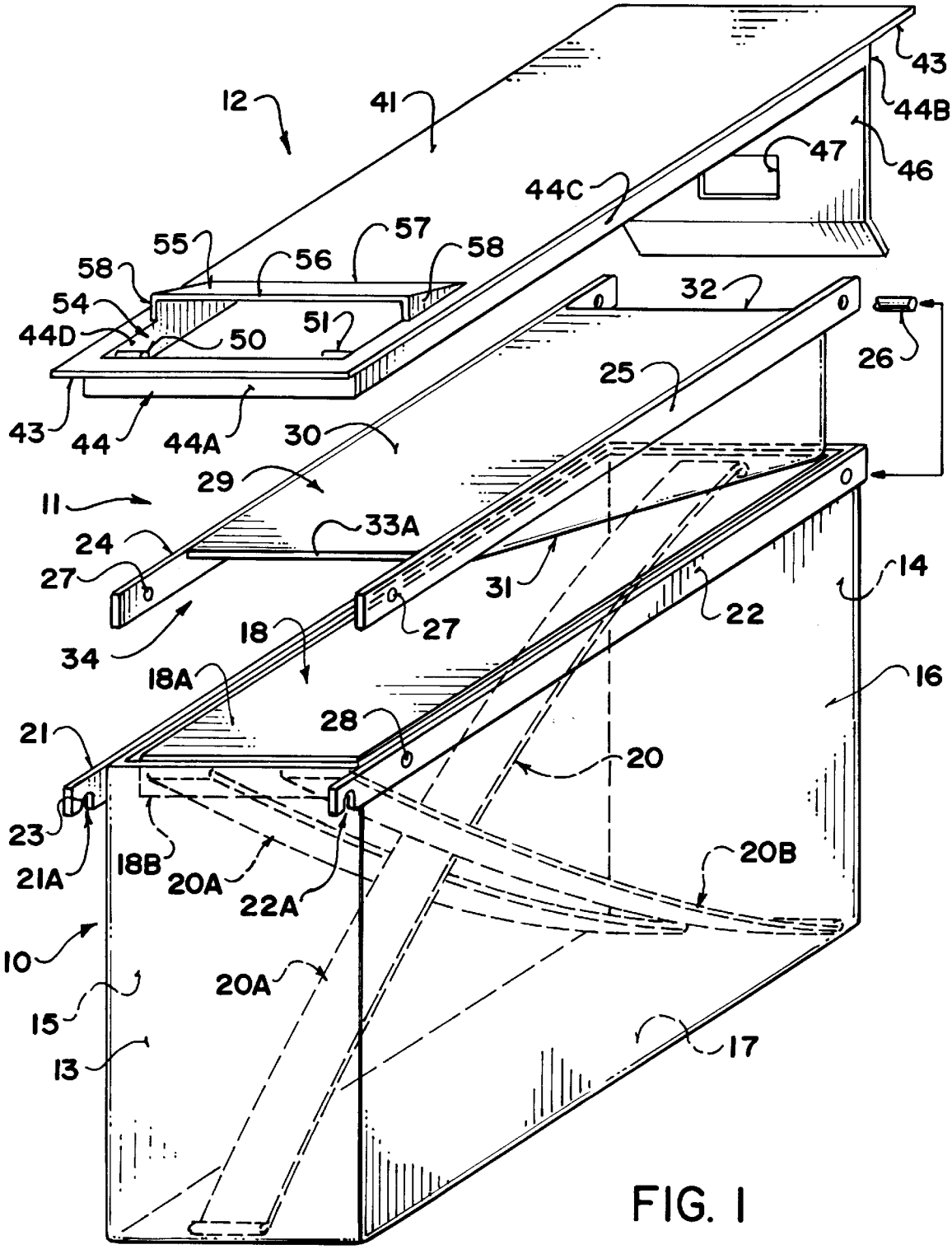
FIG. 1 is an exploded view of an apparatus according to the present invention
Figure 2:
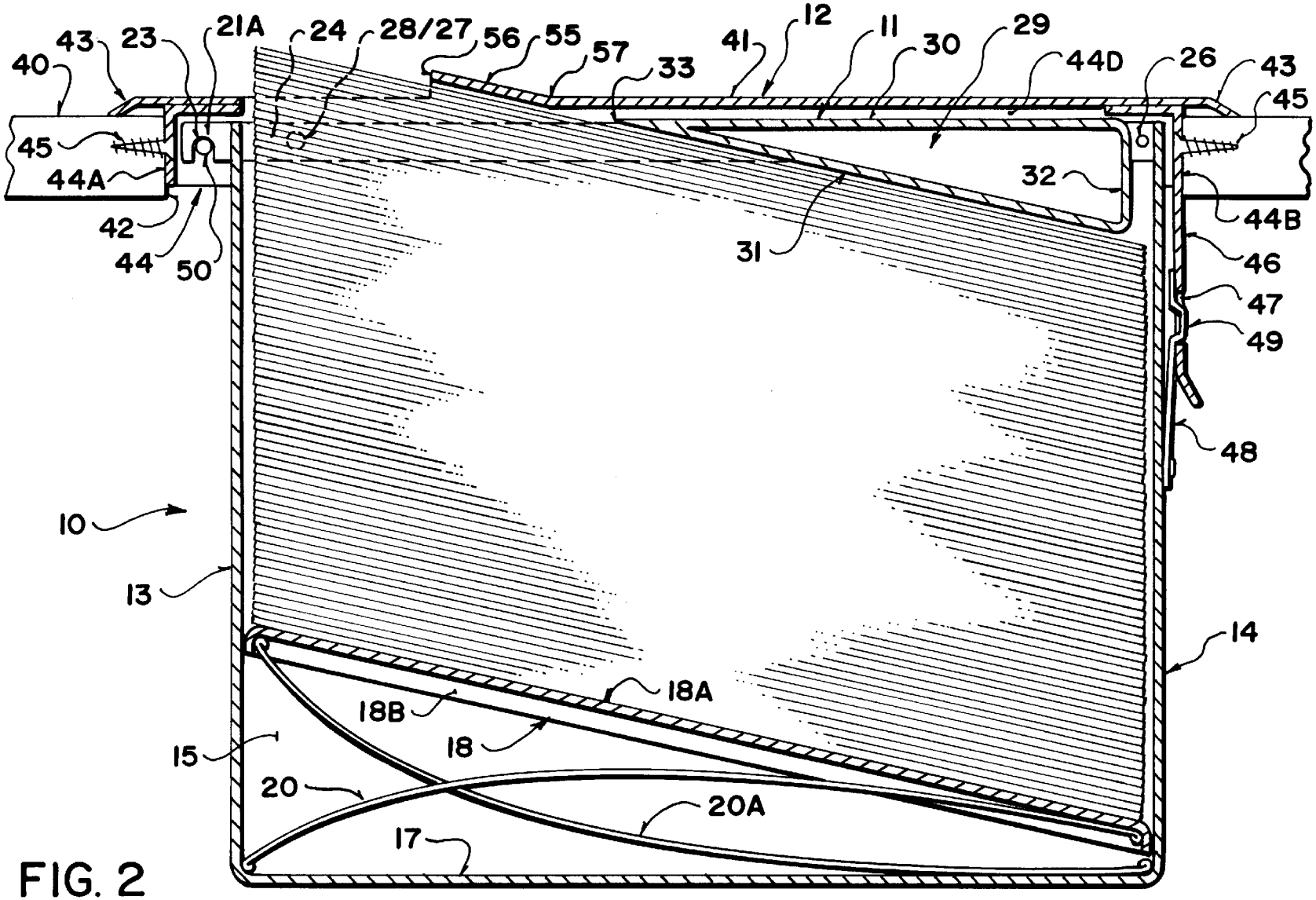
FIG. 2 is a longitudinal cross sectional view of the apparatus of FIG. 1.

The apparatus shown in FIGS. 1 and 2 comprises a container portion 10, a first container cover 11 and a second upper cover member 12. In the embodiments shown, the upper cover member defines a horizontal cover plate mounted in a horizontal counter but it will be appreciated that the same construction can be mounted in a vertical or inclined support wall as a front cover with the container being concealed behind the wall as a cartridge supply of the envelopes.

The container portion comprises a generally rectangular container having two parallel first side walls 13 and 14, and two parallel second side walls 15 and 16. The side walls are vertical and arranged at right angles and dimensioned so as to receive the envelopes in a vertical stack one on top of the other as best shown in FIG. 2. The envelopes when inserted in the container are thus confined by the container walls to the vertical stack as shown. The container further includes a rear wall 17 closing the bottom of the side walls.

The container further includes a movable wall 18 which can slide upwardly and downwardly within the container relative to the rear wall 17. The movable wall 18 includes a horizontal upper surface 18A and depending sides 18B. A spring arrangement is located between the movable wall 18 and the rear wall 17 so as to bias the movable wall 18 upwardly so as to take up a position anywhere between the rear wall and the open mouth of the container with sufficient spring bias to push the stack of envelopes upwards against its own weight so that the stack has an upward force pushing it up against the container cover regardless of the number of envelopes in the stack.

The spring 20 shown in FIGS. 1 and 2 is of the type comprising a plurality of spring steel strips which are distorted so as to provide a necessary spring action. The strips are cut from a single spring sheet so as to form preferably three strips connected at a centre section so as to maintain an integral spring structure. Two of the strips indicated at 20A and 20B extend to the end of the container adjacent to the side wall 13 and only a single one extends to the end of the container with the side wall 14. Thus there is an increase in the spring bias at the end adjacent the side wall 13 than there is at the other end so as to tend to push the forward end of the movable wall 18 upwardly with a greater force than that at the rear end.

Figure 3:
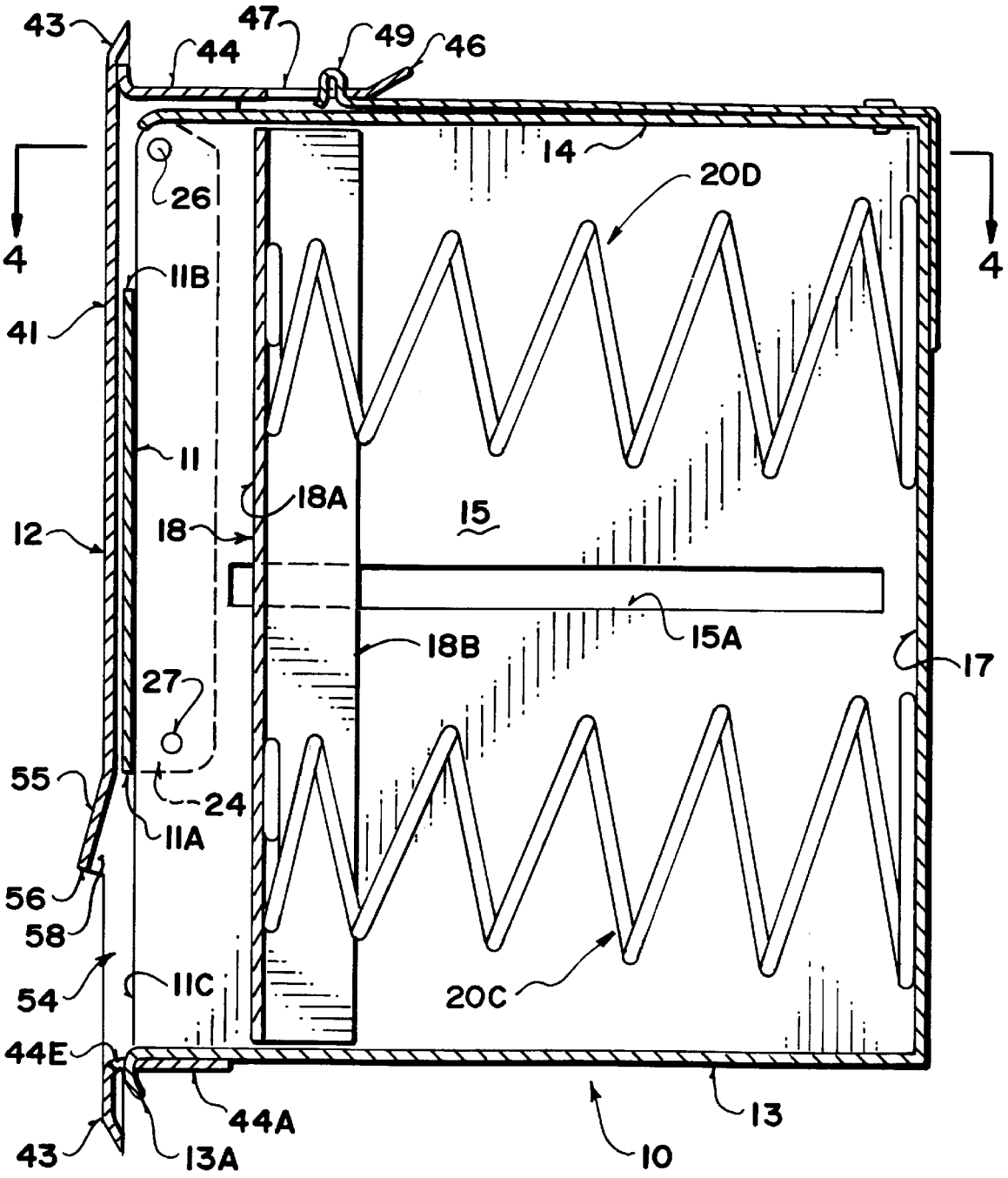
FIG. 3 is a longitudinal cross sectional view similar to that of FIG. 2 showing a modified arrangement.
Figure 4:
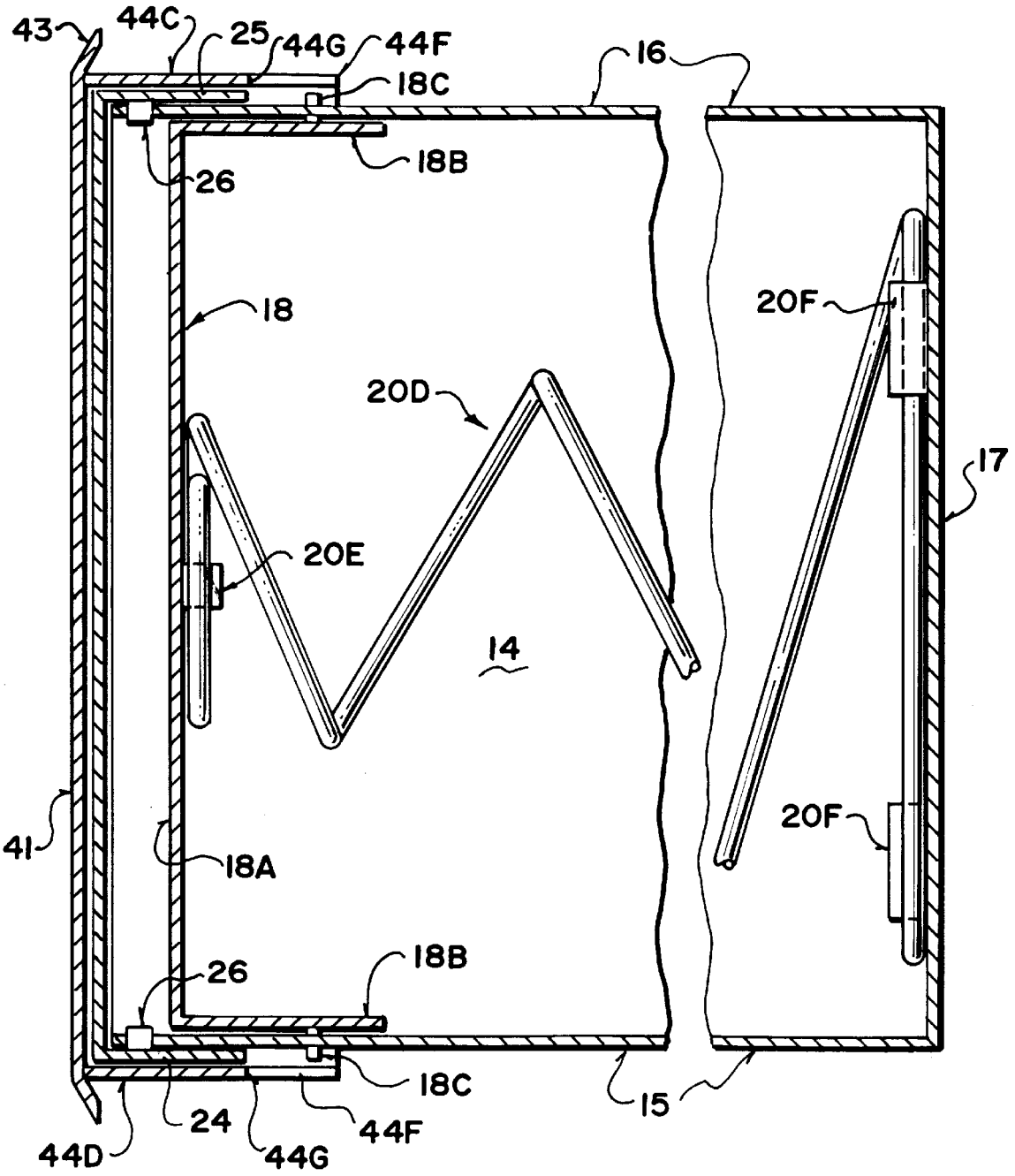
FIG. 4 is a transverse cross sectional view of the apparatus of FIG. 3.

In the embodiment shown in FIGS. 3 and 4, the spring is provided by a pair of coil springs, one 20C arranged adjacent the wall 13 and the other 20D arranged adjacent the opposite side wall 14. Again, the spring 20C is of greater force than the spring 20D. Both springs are attached to the movable wall 18 by a fastener 20E and to the rear wall 17 by engagement under tabs 20F.

In the embodiment of FIGS. 1 and 2, the container includes a pair of side strips 21 and 22 each extending along a respective side wall at the top edge of the side wall with a portion of each strip extending outwardly beyond the front wall 13 to form a hook portion 21A, 22A with a recess 23 in the underside for engaging over a rod type hanger of the upper cover 12 as discussed hereinafter.

The container cover 11 comprises a pair of side strips 24 and 25 each of which lies along the outside surface a respective one of the second side walls 15 and 16 and is pivotally connected to the respective second side wall at the end adjacent the first side wall 14 by transverse pins 26. Each of the side strips 24,25 can thus lift by pivotal movement about a horizontal axis defined by the pin 26 so that the forward end of the cover plate 11 raises upward to allow access to the interior of the container for insertion of further envelopes to supplement or replace the stack. At the forward end of each of the side strips 24 and 25 is provided a snap fastener 27 which co-operates with a snap fastening element 28 on the respective side strip 21, 22 or the side wall 15, 16 so as to snap fasten the side strip to an overlying relationship and thus hold the container cover downwardly onto the top of the container.

In FIGS. 1 and 2, the container cover further includes a generally box shaped section 29 located between the sides 24 and 25. The box shaped section includes an upper cover surface 30 at a bottom inclined wall 31. The box shaped section further includes a vertical rear wall 32. Thus the box shaped section is generally triangular in cross section as shown in FIG. 2 and converges to a forward apex 33 which is either sharp as shown in FIG. 2 or can be defined by a short vertical wall 33A as shown in FIG. 1. The apex 33 is spaced rearwardly from the forward end of the side strips 24 and 25 so as to leave an opening 34 between the apex 33 and the front wall 13.

The inclined bottom surface 31 thus presses down against the top of the stack of envelopes so as to hold the stack downwardly and thus form an incline in the stack. As the stack is substantially incompressible, this presses also at the bottom of the stack onto the movable wall 18 so that the wall 18 lies generally parallel to the incline surface 31. In FIG. 1, the stack has been removed and the cover lifted upwardly so that the movable wall is moved to the top of the container. However as soon as the cover is moved to the closed position shown in FIG. 2, the movable wall 18 will be compressed downwardly either by direct engagement with the bottom surface 31 or through the force applied by the stack of envelopes.

The second front cover 12 comprises a separate element for mounting in a counter top or support wall 40. The cover 12 comprises a generally flat upper plate 41 which lies over a hole or opening 42 in the countertop 40 and defines a surrounding lip 43 which engages onto the edge of the countertop surrounding the opening 42. The cover further includes a depending receptacle 44 which is defined into a rectangular shape by side walls 44A, 44B, 44C and 44D and is welded to the underside of the plate 41 at a position so as to engage the edge of the opening 42. The side walls 44A to D are fastened to the edge of the opening by screws 45.

At the side wall 14, the flange 44B extends further downwardly to form a depending wall 46 which extends across the full width of the container and includes an opening 47 at a position spaced downwardly from the underside of the front plate 41. The side wall 14 of the container includes a spring steel snap closure 48 with a button 49 which projects into the opening 47 as a snap fastening engagement which can be released by compressing the button 49. IN FIGS. 3 and 4, the spring strip 48 is of increased length so as to extend to the rear wall 17. Also the button 49 has a sharp corner engaging the edge of the opening 47 to provide sufficient hold on the container to prevent it slipping out under its own weight and such that the strip 48 must be compressed to push the button out of the opening before the contained can be released.

In FIGS. 1 and 2, the inside of the receptacle 44 at the sides adjacent the side wall 13 carries a pair of hanger rods 50 and 51 over which the hooks 23 engage. Thus the container is mounted in place under the counter top supported on the upper cover by firstly hooking the hooks 23 over the pins 50 and 51 and then pivoting the other end part of the container upwardly until the snap fastening element engages into the opening 47. Removal is effected in the reverse operation so that the rear is firstly pulled downwardly thus releasing the container to be pivoted and moved slightly rearwardly to release the hooks 23 from the pins 50 and 51.

The second cover further an opening 54 generally aligned with the opening 34 so that the top of the stack which is pushed through the opening 34 by the bottom plate and its co-operation with the inclined surface 31 also pushes the same stack portion through the opening 54. To improve the presentation of the top of the stack of envelopes, the opening 54 includes a mouth 55 in the form of an inclined plate or lip which has a front edge 56 and is inclined downwardly and rearwardly to a line 57 at which it joins the top wall 41. Triangular sides 58 close the sides of the mouth. In this way the top few envelopes are presented upwardly under the under surface of the wall 55 of the mouth which is at the same angle and aligned with the wall 31.

In this way one or more envelopes is presented which can be taken by the user and the envelopes are provided in an attractive stack while discouraging waste or misuse of the envelopes since they are presented in effect one at a time or a few at a time.

In the arrangement of FIG. 3 and 4, there are some minor modifications beyond those described hereinbefore. In this embodiment, the hanger by which the side wall 13 is attached to the wall 44A of the receptacle of the cover plate is formed by a top flange 13A of the side wall 13 which is turned at right angles to the side wall with an edge lip which is turned back down along the side wall 13 to form in effect a hook shape of the flange 13A. A slot is arranged in the wall 44A of the receptacle directly adjacent the plate 41 so that in a first movement the flange is pushed upwardly inside the wall 44A until the flange 13A engages into the slot indicated at 44E. The upper part of the container in the orientation shown in FIG. 3 is then pivoted about an axis defined between the flange 13A and the slot 44E until the end of the side wall 14 engages into the receptacle for the snap fastening of the button 49 into the opening 47. To assist in guiding the container into the receptacle, the walls 44C and 44D of the receptacle have depending guide lugs 44F which extend out beyond the edge 44G of the wall.

Also in the embodiment shown in FIGS. 3 and 4, the box section 29 is omitted so that the cover 11 forms a simple flat sheet with an edge 11A adjacent the opening 54 and an opposed edge 11B spaced inwardly of the pin 26. The edge 11A is outside of the opening 54 so that the part of the container which is exposed beyond the end of the cover 11 as indicated at 11C is larger than the opening 54. Preferably the edge 11A is arranged at or just beyond the junction of the lip 55 with the wall 41 so as to allow the envelopes to extend outwardly through the opening as guided by the lip 55 so that the edge of the envelope lying along the side walls 13 is presented forwardly of the plate 41.

In similar other embodiments (not shown) an inclined plate similar to the plate 31 but of reduced angle of inclination can be provided in the embodiment of FIGS. 3 and 4.

The movable plate 18 carries a pair of tabs 18C projecting outwardly from the depending side walls 18B and engaging into respective ones of a pair of slots 15A in the side walls 15 and 16. The slots extend along the extent of movement of a moveable member from a position closely adjacent the rear wall 17 to a position adjacent to but spaced downwardly from the open mouth. The tabs can be highlighted by coloured marking so that an operator can readily see the location of the removal plate within the container to see whether the container requires refilling without withdrawing the container from its position in the receptacle.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for dispensing flat envelopes which are rectangular in plan comprising:

a wall having an opening therein;

a cover plate fixedly mounted on the wall at the opening so as to cover the opening, the cover plate having;

a central plate portion covering the opening and flange portions surrounding the opening and engaging the wall around the opening;

a front facing forwardly of the wall for presentation to a user;

and an opposite rear face;

a stack of envelopes;

and a rectangular container containing the envelopes having;

two first side walls which are parallel and spaced by a width of the envelopes and two second side walls at right angles to the first side walls and spaced by a length of the envelopes to receive and contain the envelopes arranged in a stack, an open front end and a rear end;

a movable end wall in front of the rear end and generally transverse to the side walls for engaging a rear end of the stack;

and a spring between the rear end and the end wall biasing the end wall along the container for pushing the stack toward the open front end of the container to present a front one of the envelopes in turn from a front end of the stack;

the cover plate having an opening in the central plate portion at which one end of the front envelope is exposed for withdrawal of the front envelope through the opening, the opening extending in a direction along the length of the envelope from a first edge at one of the second side walls to a second edge partly along the container and the opening extending in a direction across the width of the envelope from one of the first side walls to the other of the first side walls;

the cover plate and the container having cooperating mounting elements for mounting the container behind the rear face of the central plate portion of the cover plate and for allowing removal of the container rearwardly of the cover plate for refilling of the container with envelopes.

2. The apparatus according to claim 1 wherein the spring is arranged so as to provide a greater force on the movable end wall of the container at an end of the end wall at the opening than at an end of the end wall opposite to the opening.

3. The apparatus according to claim 1 wherein there is provided an abutment plate inclined relative to the open end of the container and the cover plate in a direction away from the opening in the cover plate and into the container for contacting the front envelope and holding the front envelope inclined to the cover plate with said one end of the front envelope presented into the opening.

4. The apparatus according to claim 1 wherein the cover plate includes a raised lip along the second side of the opening, the lip being inclined from a position spaced from the second edge of the opening forwardly and toward the second edge of the opening so as to present the second edge of the opening forwardly of the cover plate to allow the edge of the front envelope to be presented in the opening forwardly of the cover plate.

5. The apparatus according to claim 1 wherein there is provided a container cover plate mounted on the container for holding the stack within the container, the container cover plate being shaped to leave one part of the open front end at one of the first side walls open to expose the front envelope of the stack at said one part.

6. The apparatus according to claim 5 wherein the container cover plate includes a pair of side members each extending along a respective one of the second sides of the container and each including fastening means for engaging the first cover plate to the container.

7. The apparatus according to claim 5 wherein the container cover plate is pivotally attached to the container allowing the container cover plate to be opened for insertion of further envelopes into the stack by pushing down on the movable end wall.

8. The apparatus according to claim 7 wherein the container cover plate is pivotal relative to the container at an end thereof opposite the opening.

9. Apparatus for dispensing flat envelopes which are rectangular in plan comprising:

a wall having an opening therein;

a cover plate fixedly mounted on the wall at the opening so as to cover the opening, the cover plate having;

a central plate portion covering the opening and flange portions surrounding the opening and engaging the wall around the opening;

a front face facing forwardly of the wall for presentation to a user;

and an opposite rear face;

a stack of envelopes;

and a rectangular container containing the envelopes having;

two first side walls which are parallel and spaced by a width of the envelopes and two second side walls at right angles to the first side walls and spaced by a length of the envelopes to receive and contain the envelopes arranged in a stack, an open front end and a rear end;

a movable end wall in front of the rear end and generally transverse to the side walls for engaging a rear end of the stack;

and a spring between the rear end and the end wall biasing the end wall along the container for pushing the stack toward the open front end of the container to present a front one of the envelopes in turn from front end of the stack;

the cover plate having an opening in the central plate portion at which one end of the front envelope is exposed for withdrawal of the front envelope through the opening, the opening extending in a direction along the length of the envelope from a first edge at one of the second side walls to a second edge partly along the container and the opening extending in a direction across the width of the envelope from one of the first side walls to the other of the first side walls;

the cover plate having mounting elements thereon for mounting the container behind the rear face of the central plate portion of the cover plate and for allowing removal of the container rearwardly of the cover plate for refilling of the container with envelopes;

wherein the container attaches to the cover plate by a hanger member at one of the first side walls which engages over an abutment of the cover plate to be suspended therefrom and a snap fastening engagement at the opposed one of the first side walls which engages into a receptacle attached to the cover plate to hold the container releasably attached to the cover plate.

10. The apparatus according to claim 9 wherein the cover plate includes a projecting wall at said opposed one of the first side walls which projecting wall extends generally at right angles to the cover plate and includes an opening defining said receptacle and wherein the snap fastening arrangement of the container includes a spring blade attached to and inclined outwardly from said opposed one of the first side walls for engaging a catch portion of the spring blade into said opening in the projecting wall.

11. The apparatus according to claim 9 wherein the cover plate includes a projecting wall at said one of the first side walls which projecting wall extends generally at right angles to the cover plate and includes an opening defining said abutment and wherein the hanger of the container includes a flange attached to and extending outwardly from an end of said one of the first side walls at said open mouth for engaging of the flange into said opening in the projecting wall.

12. The apparatus according to claim 9 wherein the spring is arranged so as to provide a greater force on the movable end wall of the container at an end of the end wall at the opening in the cover plate than at an end of the end wall opposite to the opening.

13. The apparatus according to claim 9 wherein there is provided an abutment plate inclined relative to the open end of the container and the cover plate in a direction away from the opening in the cover plate and into the container for contacting the front envelope and holding the front envelope inclined to the cover plate with said one end of the front envelope presented into the opening.

14. The apparatus according to claim 9 wherein the cover plate includes a raised lip along the second side of the opening, the lip being inclined from a position spaced from the second edge of the opening forwardly and toward the second edge of the opening so as to present the second edge of the opening forwardly of the cover plate to allow the edge of the front envelope to be presented in the opening forwardly of the cover plate.

15. The apparatus according claim 9 wherein there is provided a container cover plate mounted on the container for holding the stack within the container, the container cover plate being shaped to leave one part of the open front end at one of the first side walls open to expose the front envelope of the stack at said one part.

16. Apparatus for use at an ATM comprising:

a wall having an opening therein;

a cover plate fixedly mounted on the wall at the opening so as to cover the opening, the cover plate having;

a central plate portion covering the opening and flange portions surrounding the opening and engaging the wall around the opening;

a front face facing forwardly of the wall for presentation to a user;

and an opposite rear face;

and a rectangular container having:

two first side walls which are parallel and spaced and two second side walls at right angles to the first side walls and spaced, an open front end and a rear end;

the cover plate having a slot shaped opening in the central plate portion;

the cover plate having mounting elements thereon for mounting the container behind the rear face of the central plate portion of the cover plate and for allowing removal of the container rearwardly of the cover plate;

wherein the container attaches to the cover plate by a hanger member at one of the first side walls which engages over an abutment of the cover plate to be suspended therefrom and a snap fastening engagement at the opposed one of the first side walls which engages into a receptacle attached to the cover plate to hold the container releasably attached to the cover plate.

17. The apparatus according to claim 16 wherein the cover plate includes a projecting wall at said opposed one of the first side walls which projecting wall extends generally at right angles to the cover plate and includes an opening defining said receptacle and wherein the snap fastening engagement of the container includes a spring blade attached to and inclined outwardly from said opposed one of the first side walls for engaging a catch portion of the spring blade into said opening in the projecting wall.

18. The apparatus according to claim 16 wherein the cover plate includes a projecting wall at said one of the first side walls which projecting wall extends generally at right angles to the cover plate and includes an opening defining said abutment and the hanger member of the container includes a flange attached to and extending outwardly from an end of said one of the first side walls at said open mouth for engaging of the flange into the opening in the projecting wall.

* * * * *